US005159740A

United States Patent [19]

Brüstle et al.

[11] Patent Number: 5,159,740

[45] Date of Patent: Nov. 3, 1992

[54] HINGE WITH SPRING COUPLING MEMBER

[75] Inventors: Klaus Brüstle, Höchst; Andreas Töfferl, Hard; Erich Röck, Höchst, all of Austria

[73] Assignee: Julius Blum Gesellschaft m.b.H., Höchst, Austria

[21] Appl. No.: 694,946

[22] Filed: May 2, 1991

[30] Foreign Application Priority Data

May 19, 1990 [DE] Fed. Rep. of Germany ... 9005706[U]

[51] Int. Cl.[5] ..... E05D 7/10

[52] U.S. Cl. ..... 16/258; 16/382; 16/DIG. 43; 16/270

[58] Field of Search ..... 16/257, 258, 259, 260, 16/261, 270, 382, 383, 384, 387, 388, 238

[56] References Cited

U.S. PATENT DOCUMENTS

| | | | |
|---|---|---|---|
| 4,691,408 | 9/1987 | Rock et al. | 16/382 |
| 4,800,622 | 1/1989 | Rock et al. | 16/382 |
| 4,839,940 | 6/1989 | Grass | 16/258 |
| 4,850,080 | 4/1989 | Rock et al. | 16/258 |
| 4,881,297 | 11/1989 | Grass | 16/382 |

FOREIGN PATENT DOCUMENTS 8902577 3/1990 Spain .

*Primary Examiner*—Lowell A. Larson
*Assistant Examiner*—Michael J. McKeon
*Attorney, Agent, or Firm*—Wenderoth, Lind & Ponack

[57] ABSTRACT

A hinge includes a hinge arm mounted on a base plate by an intermediate member having a U-shaped cross-section. The hinge arm is retained on the intermediate member by depth and joint adjustment devices, e.g. clamping and adjusting screws. Retaining elements of the intermediate member engage corresponding retaining elements of the base plate at two points staggered over the length of the base plate. The retaining elements are rigid at one such point, and the other point one retaining element is resilient. The hinge arm and the intermediate member engages the base plate with the rigid retaining elements and snaps only the base plate due to the resilient retaining element, in the form of a leaf spring. A rear end the intermediate member is provided with a bridge which defines a gap into which is inserted the leaf spring. A flap is punched from the leaf spring and engages in a recess of the intermediate member arranged underneath the bridge, thus locking the leaf spring to the intermediate member.

17 Claims, 4 Drawing Sheets

HINGE WITH SPRING COUPLING MEMBER

FIELD AND BACKGROUND OF THE INVENTION

The invention relates to a hinge with a hinge arm which is mounted on a base plate by means of an intermediate member of U-shaped cross-section and which is retained on the intermediate member by means for depth and joint adjustment, for example clamping and adjusting screws. The intermediate member is engaged with the base plate retaining elements of the intermediate member engaging corresponding retaining elements of the base plate at two points staggered over the length of the base plate. The retaining intermediate member elements are rigid at one of such points and resilient at the other of such points, so that the hinge arm with the intermediate member is engageable with the base plate by the rigid retaining element and snaps onto the base plate by means of the resilient retaining element which is part of a leaf spring.

Hinges of this type have the advantage that the hinge arm with the intermediate member can be mounted on the base plate and released therefrom without a tool. EP-PS 200 744 describes a hinge including a pivot lever which is acted upon by a spring and which has a projection which engages behind a corresponding projection of the base plate. Further, this European patent specification shows a hinge in which a leaf spring is held directly at the hinge arm by a clamping screw.

SUMMARY OF THE INVENTION

It is an object of the invention to simplify a hinge of the above-mentioned type and to make the depth adjustment of the hinge independent of the means for mounting the leaf spring.

According to the invention this object is achieved by providing a rear end of the intermediate member is provided with a bridge limiting or defining a gap into which is inserted the leaf spring. A flap is punched from the leaf spring and engages in a recess of the intermediate member arranged underneath the bridge, thus locking the leaf spring at its point of anchoring to the intermediate member.

To facilitate in particular releasing of the intermediate member and thus of the hinge arm from the base plate, an embodiment of the present invention provides that behind the intermediate member the leaf spring has a U-shaped region adjoining a handle member.

Since the leaf spring enables quick locking but not firm positioning of the intermediate member, it is advantageously provided that the intermediate member has at lateral flanges thereof projections which extend into corresponding slots in the base plate, thus defining the position of the intermediate member on the base plate at which the leaf spring engages the base plate.

BRIEF DESCRIPTION OF THE DRAWINGS

In the following an embodiment of the invention will be described in more detail with reference to the accompanying drawings, in which.

DETAILED DESCRIPTION OF THE INVENTION

Figure 1:
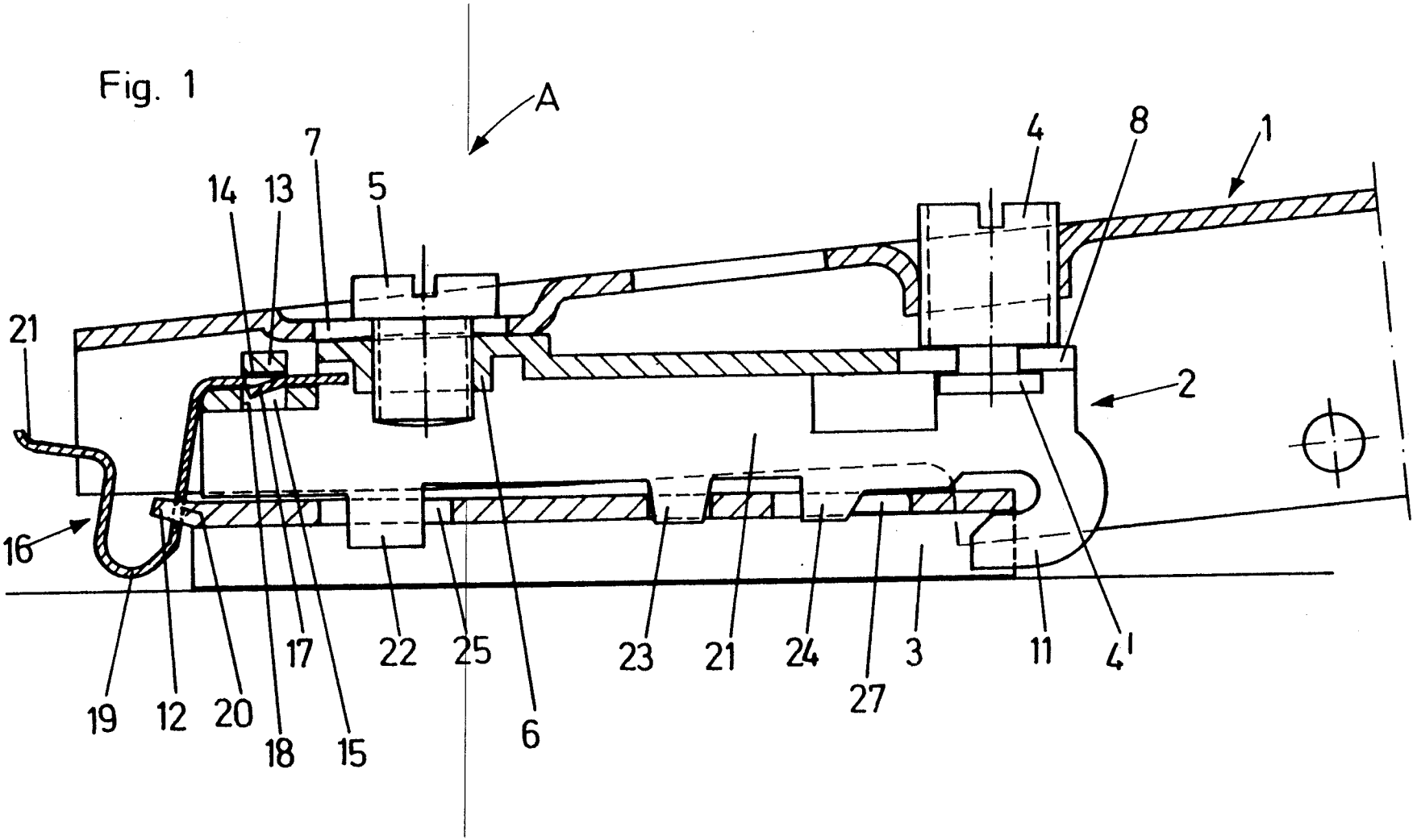
FIG. 1 is a longitudinal sectional view of a hinge arm, an intermediate member and a base plate.
Figure 3:
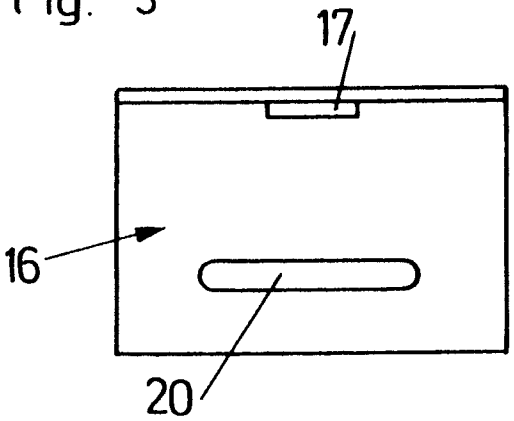
FIG. 3 is an elevation of the leaf spring.
Figure 2:
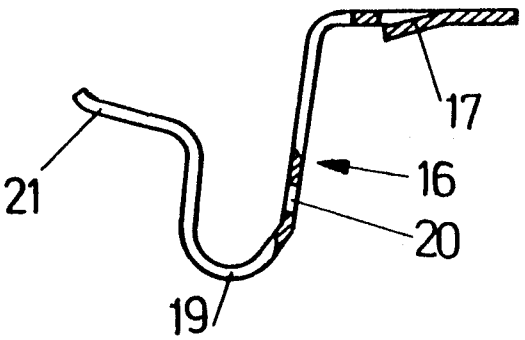
FIG. 2 is a side view of a leaf spring.
Figure 4:
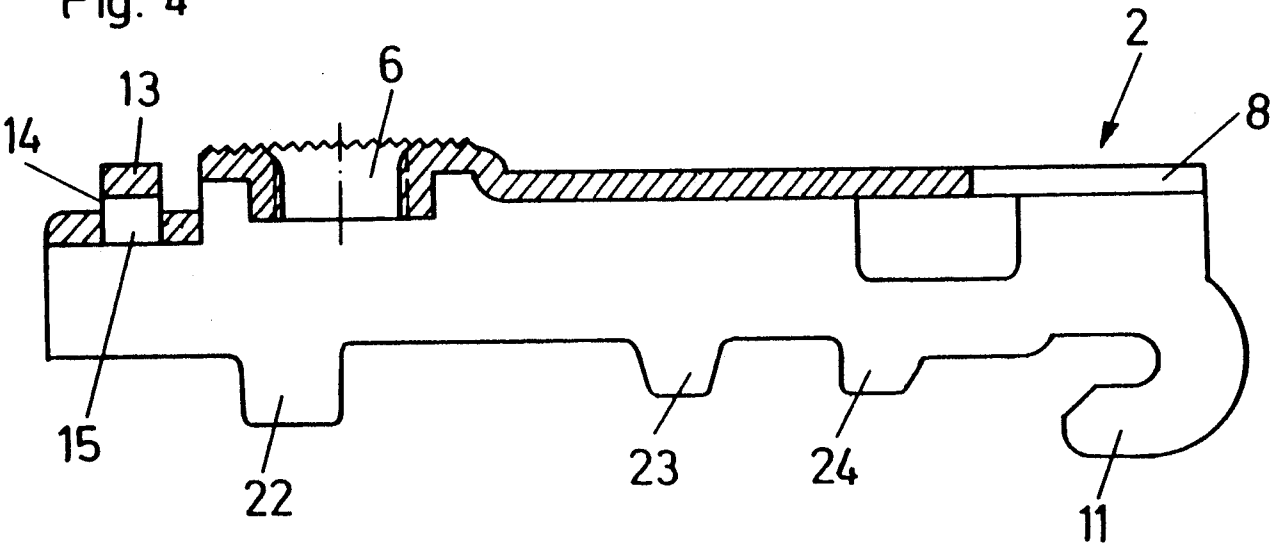
FIG. 4 is a longitudinal sectional view of the intermediate member.

The essential parts of a hinge ar a hinge arm 1, an intermediate member 2 and a base plate 3. The hinge arm 1 is, by means of a joint adjustment screw 4 and a clamping screw 5, retained on the intermediate member 2. The clamping screw 5 is mounted in a female thread 6 of the intermediate member 2 and projects through a slot 7 in the hinge arm 1. The joint adjustment screw 4 has a head 4' by means of which it is engageable in a forwardly open slot 8 in the intermediate member 2. The lengths of the slots 7, 8 are preferably equal. by loosening the clamping screw 5, the hinge arm 1 can be adjusted over the length of slots 7, 8 in the direction of the depth of the furniture unit. After this positioning, the clamping screw 5 is tightened to fix the hinge arm 1 to the intermediate member. The hinge arm 1 is adjustable in the direction of the breadth of a door joint by turning the joint adjusting screw 4.

The base plate 3 is, in some regions thereof, U-shaped and has two lateral fastening flanges 9 in which are provided oblong holes 10 for fastening screws, not shown.

As can be seen from FIG. 1, the intermediate member 2 is, at a rear end thereof beyond the female thread 6, provided with a bridge 13 which defines a gap 14. A recess 15 is arranged underneath the bridge 13.

A leaf spring 16 has a flange inserted into the gap 14. Moreover, the leaf spring 16 has a punched flap 17 which engages in the recess 15 and rests against a wall 18 thereof so that the leaf spring 16 is fixed to the intermediate member 2. The leaf spring 16 has a U-shaped region 19 positioned longitudinally beyond the intermediate member. Region 19 has in one leg thereof an opening 20 through which extends projection 12 of the base plate 3 when the intermediate member 2 is in a locked position. A handle member 21, by means of which the leaf spring 16 can be manually lifted from the projection 12, adjoins the U-shaped region 19 at the rear thereof.

For mounting the hinge arm 1, it is sufficient to engage one or more projections 11 of intermediate member 2 with the front of the base plate 3 and to pivot or turn member 2 about the thus formed pivot bearing or axis in the direction of arrow A in FIG. 1 until the leaf spring 16 snaps over projection 12.

In order to position the intermediate member 2 precisely on the base plate 3, lateral flanges 2' of the intermediate member 2 are provided with projections 22, 23 and 24 that extend into corresponding slots 25, 265 and 27 in the base plate 3 when the intermediate member 2 is in the mounted position. The projections 22 and 24 and the slots 25 and 27 serve in this arrangement for the positioning of intermediate member 2 in the direction of the furniture height, while the projections 23 and the slot 26 serve for the positioning of the intermediate member 2 in the direction of the depth of the furniture unit.

Figure 5:
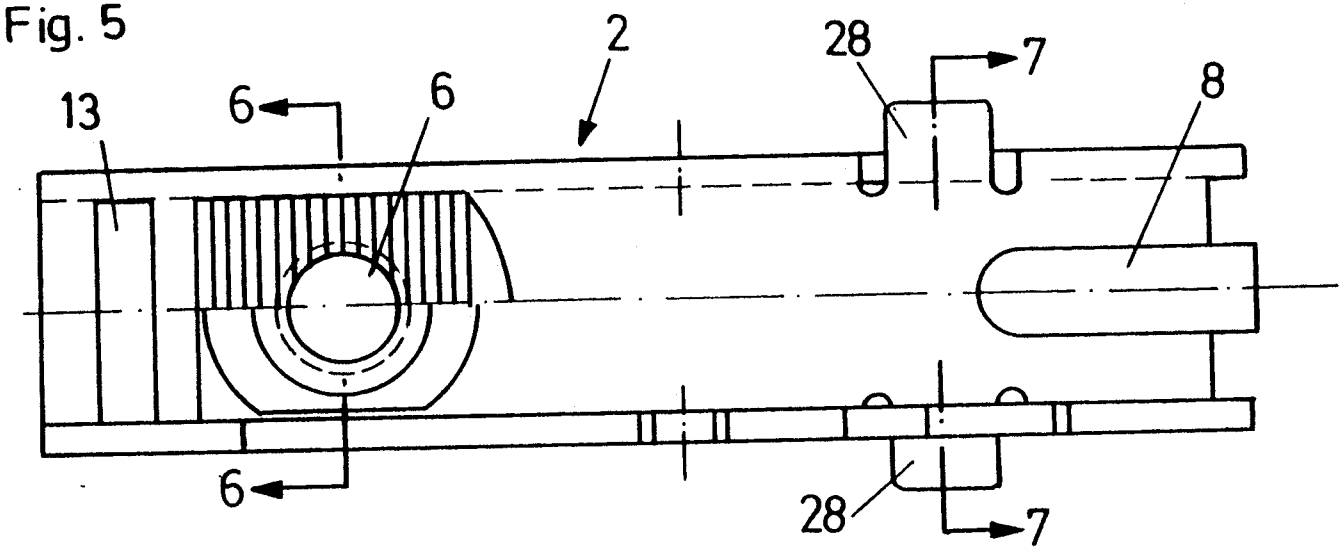
FIG. 5 is a top view of the intermediate member.
Figure 7:
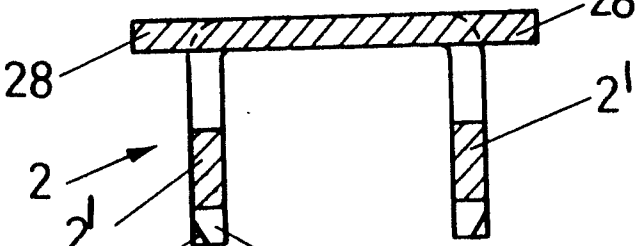
FIG. 7 is a sectional view along line 7—7 of FIG. 5.
Figure 6:
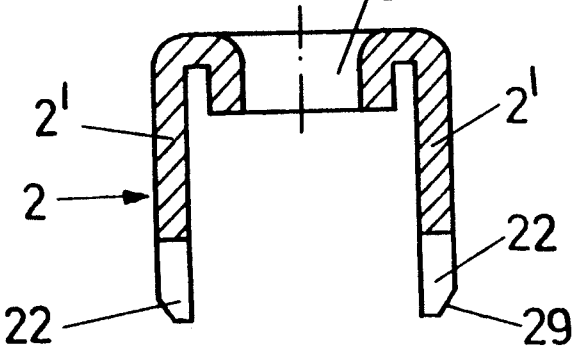
FIG. 6 is a sectional view along line 6—6 of FIG. 5.
Figure 8:
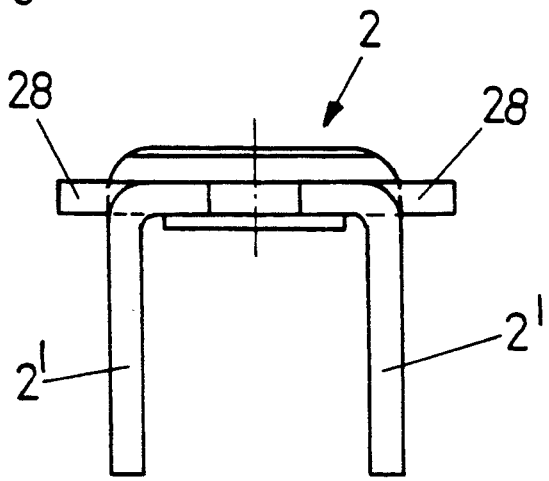
FIG. 8 is a front view of the intermediate member.
Figure 9:
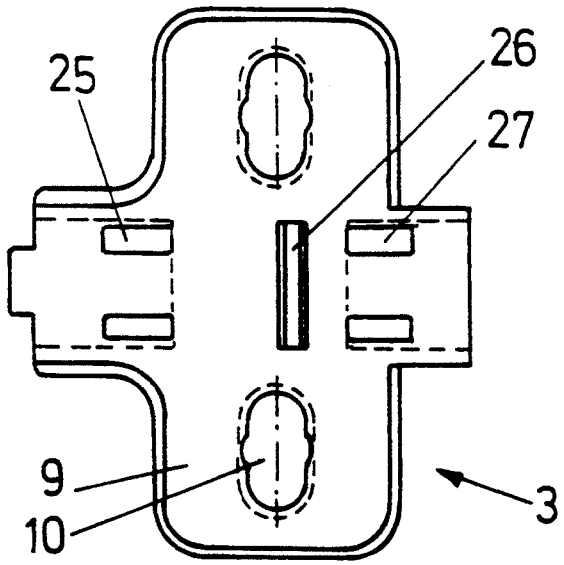
FIG. 9 is a top view of the base plate.

As can be seen from FIGS. 5, 7 and 8, the intermediate member 2 is provided with horizontal flaps 28 on which abut lateral flanges of the hinge arm 1. The hinge arm 1 thus is retained on the intermediate member 2 without clearance therebetween.

The projections 22 and 24 advantageously are provided with beveled regions 29 which facilitate the insertion of projections 22, 24 into the slots 25, 27. The projections 23 are conical when viewed laterally, so that a firm seat in slot 26 is guaranteed.

What is claimed is:

1. A hinge comprising:

a mounting plate;

a hinge arm;

a longitudinal intermediate member having a U-shaped transverse cross-sectional configuration;

said hinge arm being retained on said intermediate member by depth and joint adjustment devices;

said intermediate member being retained on said mounting plate by means of respective retaining elements located at two positions spaced longitudinally of said intermediate member and said mounting plate;

said retaining elements at a first said position being rigid and defining a pivot axis about which said intermediate member is pivotable relative to said mounting plate;

said retaining element of said intermediate member at a second said position comprising a resilient member such that, when said intermediate member pivots about said pivot axis toward said mounting plate, said resilient member snaps into engagement with said retaining element of said mounting plate at said second position, thereby mounting said intermediate member and said hinge arm on said mounting plate;

said resilient member comprising a leaf spring having means for engaging said retaining element of said mounting plate at said second position; and said leaf spring and said intermediate member having cooperating structure anchoring said leaf to said intermediate member, said cooperating structure comprising a bridging portion of said intermediate member spaced from the remainder of said intermediate member and defining therebetween a gap, an end portion of said leaf spring inserted into said gap, and a flap extending from said end portion of said leaf spring and abutting said intermediate member, thus preventing withdrawal of said end portion of said leaf spring from said gap.

2. A hinge as claimed in claim 1, wherein said bridging portion is formed by deforming part of the material of said intermediate member to thus provide therein a recess bordering said gap.

3. A hinge as claimed in claim 2, wherein said flap abuts an edge surface defining said gap.

4. A hinge as claimed in claim 1, wherein said flap is deformed from the material of said end portion of said leaf spring.

5. A hinge as claimed in claim 1, wherein said end portion of said leaf spring extends longitudinally parallel to the longitudinal direction of said intermediate member.

6. A hinge as claimed in claim 5, wherein said flap extends in a direction inclined to said end portion.

7. A hinge as claimed in claim 1, wherein said leaf spring includes a U-shaped portion including first and second spaced legs joined at first ends thereof by a web.

8. A hinge as claimed in claim 7, wherein said end portion extends laterally from a second end of said first leg.

9. A hinge as claimed in claim 8, wherein said leaf spring includes, at a second end of said second leg, a handle portion to enable said leaf spring to be manipulated to release engagement thereof with said retaining element of said mounting plate at said second position.

10. A hinge as claimed in claim 9, wherein said handle portion extends in a direction opposite to that of said end portion.

11. A hinge as claimed in claim 8, wherein said engaging means of said leaf spring comprises an opening extending through said first leg.

12. A hinge as claimed in claim 11, wherein said retaining element of said mounting plate at said second position comprises a projection extending into said opening.

13. A hinge as claimed in claim 1, wherein said bridging portion is located adjacent one longitudinal end of said intermediate member, and said depth and joint adjustment devices are spaced from said bridging portion in a direction toward an opposite longitudinal end of said intermediate member.

14. A hinge as claimed in claim 1, wherein said intermediate member has flaps projecting from opposite lateral sides thereof.

15. A hinge as claimed in claim 14, wherein said flaps are deformed from the material of spaced lateral flanges defining said U-shaped configuration of said intermediate member.

16. A hinge as claimed in claim 1, wherein said intermediate member includes a pair of spaced, longitudinally extending lateral flanges.

17. A hinge as claimed in claim 16, wherein said lateral flanges have projecting from edges thereof projections fitting into corresponding slots formed in said mounting plate.

* * * * *